US006938697B2

(12) United States Patent
Haugen

(10) Patent No.: US 6,938,697 B2
(45) Date of Patent: Sep. 6, 2005

(54) APPARATUS AND METHODS FOR TUBULAR MAKEUP INTERLOCK

(75) Inventor: David M. Haugen, League City, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/801,514

(22) Filed: Mar. 16, 2004

(65) Prior Publication Data

US 2004/0173358 A1 Sep. 9, 2004

Related U.S. Application Data

(62) Division of application No. 09/860,127, filed on May 17, 2001, now Pat. No. 6,742,596.

(51) Int. Cl.[7] ..... E21B 19/16

(52) U.S. Cl. ..... 166/380; 166/53; 166/77.51; 166/85.1; 166/377

(58) Field of Search ..... 166/53, 77.51–77.53, 166/85.1, 85.5, 377, 378, 380; 175/65, 85; 294/86.24, 86.25

(56) References Cited

U.S. PATENT DOCUMENTS

| | | | |
|---|---|---|---|
| 2,167,338 | A | 7/1939 | Murcell |
| 2,228,503 | A | 1/1941 | Boyd et al. |
| 2,370,832 | A | 3/1945 | Baker |
| 2,379,800 | A | 7/1945 | Hare |
| 2,414,719 | A | 1/1947 | Cloud |
| 2,720,267 | A | 10/1955 | Brown |
| 2,741,907 | A | 6/1956 | Genender et al. |
| 3,006,415 | A | 10/1961 | Burns et al. |
| 3,041,901 | A | 7/1962 | Knights |
| 3,054,100 | A | 9/1962 | Jones |
| 3,090,031 | A | 5/1963 | Lord |
| 3,111,179 | A | 11/1963 | Albers et al. |

(Continued)

FOREIGN PATENT DOCUMENTS

| | | |
|---|---|---|
| CA | 2 335 192 | 11/2001 |
| DE | 35 23 221 | 2/1987 |
| DE | 3 918 132 | 12/1989 |
| EP | 0 087 373 | 8/1983 |
| EP | 0 162 000 | 11/1985 |

(Continued)

OTHER PUBLICATIONS

Detlef Hahn, Friedhelm Makohl, and Larry Watkins, Casing–While Drilling System Reduces Hole Collapse Risks, Offshore, pp. 54, 56, and 59, Feb. 1998.

Yakov A. Gelfgat, Mikhail Y. Gelfgat and Yuri S. Lopatin, Retractable Drill Bit Technology—Drilling Without Pulling Out Drillpipe, Advanced Drilling Solutions Lessons From the FSU; Jun. 2003; vol. 2, pp. 351–464.

Tommy Warren, SPE, Bruce Houtchens, SPE, Garret Madell, SPE, Directional Drilling With Casing, SPE/IADC 79914, Tesco Corporation, SPE/IADC Drilling Conference 2003.

LaFleur Petroleum Services, Inc., "Autoseal Circulating Head," Engineering Manufacturing, 1992, 11 Pages.

Valves Wellhead Equipment Safety Systems, W–K–M Division, ACF Industries, Catalog 80, 1980, 5 Pages.

Canrig Top Drive Drilling Systems, Harts Petroleum Engineer International, Feb. 1997, 2 Pages.

(Continued)

*Primary Examiner*—Zakiya Walker
(74) *Attorney, Agent, or Firm*—Moser, Patterson & Sheridan

(57) ABSTRACT

Apparatus and methods are provided to prevent an operator from inadvertently dropping a string into a wellbore during assembling and disassembling of tubulars. Additionally, the apparatus and methods can be used to for running in casing, running in wellbore components or for a drill string.

31 Claims, 10 Drawing Sheets

U.S. PATENT DOCUMENTS

| | | | |
|---|---|---|---|
| 3,117,636 | A | 1/1964 | Wilcox et al. |
| 3,124,023 | A | 3/1964 | Marquis et al. |
| 3,131,769 | A | 5/1964 | Rochemont |
| 3,193,116 | A | 7/1965 | Kenneday et al. |
| 3,419,079 | A | 12/1968 | Current |
| 3,548,936 | A | 12/1970 | Kilgore et al. |
| 3,552,507 | A | 1/1971 | Brown |
| 3,552,848 | A | 1/1971 | Van Wagner |
| 3,566,505 | A | 3/1971 | Martin |
| 3,602,302 | A | 8/1971 | Kluth |
| 3,606,664 | A | 9/1971 | Weiner |
| 3,635,105 | A | 1/1972 | Dickmann et al. |
| 3,680,412 | A | 8/1972 | Mayer et al. |
| 3,691,825 | A | 9/1972 | Dyer |
| 3,696,332 | A | 10/1972 | Dickson Jr. et al. |
| 3,776,320 | A | 12/1973 | Brown |
| 3,776,991 | A | 12/1973 | Marcus |
| 3,848,684 | A | 11/1974 | West |
| 3,857,450 | A | 12/1974 | Guier |
| 3,913,687 | A | 10/1975 | Gyongyosi et al. |
| 4,054,332 | A | 10/1977 | Bryan, Jr. |
| 4,095,865 | A | 6/1978 | Denison et al. |
| 4,127,927 | A | 12/1978 | Hauk et al. |
| 4,194,383 | A | 3/1980 | Huzyak |
| 4,227,197 | A | 10/1980 | Nimmo et al. |
| 4,241,878 | A | 12/1980 | Underwood |
| 4,277,197 | A | 7/1981 | Bingham |
| 4,280,380 | A | 7/1981 | Eshghy |
| 4,311,195 | A | 1/1982 | Mullins, II |
| 4,392,534 | A | 7/1983 | Miida |
| 4,407,378 | A | 10/1983 | Thomas |
| 4,427,063 | A | 1/1984 | Skinner |
| 4,437,363 | A | 3/1984 | Haynes |
| 4,445,734 | A | 5/1984 | Cunningham |
| 4,449,596 | A | 5/1984 | Boyadjieff |
| 4,494,424 | A | 1/1985 | Bates |
| 4,529,045 | A | 7/1985 | Boyadjieff et al. |
| 4,570,706 | A | 2/1986 | Pugnet |
| 4,592,125 | A | 6/1986 | Skene |
| 4,593,773 | A | 6/1986 | Skeie |
| 4,605,268 | A | 8/1986 | Meador |
| 4,625,796 | A | 12/1986 | Boyadjieff |
| 4,646,827 | A | 3/1987 | Cobb |
| 4,649,777 | A | 3/1987 | Buck |
| 4,667,752 | A | 5/1987 | Berry et al. |
| 4,676,312 | A | 6/1987 | Mosing et al. |
| 4,683,962 | A | 8/1987 | True |
| 4,691,587 | A | 9/1987 | Farrand et al. |
| 4,709,599 | A | 12/1987 | Buck |
| 4,709,766 | A | 12/1987 | Boyadjieff |
| 4,738,145 | A | 4/1988 | Vincent et al. |
| 4,742,876 | A | 5/1988 | Barthelemy et al. |
| 4,759,239 | A | 7/1988 | Hamilton et al. |
| 4,765,401 | A | 8/1988 | Boyadjieff |
| 4,773,689 | A | 9/1988 | Wolters |
| 4,775,009 | A | 10/1988 | Wittrisch et al. |
| 4,781,359 | A | 11/1988 | Matus |
| 4,788,544 | A | 11/1988 | Howard |
| 4,791,997 | A | 12/1988 | Krasnov |
| 4,793,422 | A | 12/1988 | Krasnov |
| 4,800,968 | A | 1/1989 | Shaw et al. |
| 4,806,928 | A | 2/1989 | Veneruso |
| 4,813,493 | A | 3/1989 | Shaw et al. |
| 4,836,064 | A | 6/1989 | Slator |
| 4,867,236 | A | 9/1989 | Haney et al. |
| 4,878,546 | A | 11/1989 | Shaw et al. |
| 4,901,069 | A | 2/1990 | Veneruso |
| 4,936,382 | A | 6/1990 | Thomas |
| 4,962,579 | A | 10/1990 | Moyer et al. |
| 5,009,265 | A | 4/1991 | Bailey et al. |
| 5,036,927 | A | 8/1991 | Willis |
| 5,141,063 | A | 8/1992 | Quesenbury |
| RE34,063 | E | 9/1992 | Vincent et al. |
| 5,176,518 | A | 1/1993 | Hordijk et al. |
| 5,191,932 | A | 3/1993 | Seefried et al. |
| 5,224,540 | A | 7/1993 | Streich et al. |
| 5,233,742 | A | 8/1993 | Gray et al. |
| 5,245,265 | A | 9/1993 | Clay |
| 5,251,709 | A | 10/1993 | Richardson |
| 5,271,468 | A | 12/1993 | Streich et al. |
| 5,305,839 | A | 4/1994 | Kalsi et al. |
| 5,332,043 | A | 7/1994 | Ferguson |
| 5,351,767 | A | 10/1994 | Stogner et al. |
| 5,388,651 | A | 2/1995 | Berry |
| 5,394,823 | A | 3/1995 | Lenze |
| 5,433,279 | A | 7/1995 | Tassari et al. |
| 5,494,122 | A | 2/1996 | Larsen et al. |
| 5,501,286 | A | 3/1996 | Berry |
| 5,503,234 | A | 4/1996 | Clanton |
| 5,540,279 | A | 7/1996 | Branch et al. |
| 5,542,472 | A | 8/1996 | Pringle et al. |
| 5,542,473 | A | 8/1996 | Pringle |
| 5,553,672 | A | 9/1996 | Smith, Jr. et al. |
| 5,577,566 | A | 11/1996 | Albright et al. |
| 5,645,131 | A | 7/1997 | Trevisani |
| 5,706,894 | A | 1/1998 | Hawkins, III |
| 5,791,410 | A | 8/1998 | Castille et al. |
| 5,803,191 | A | 9/1998 | Mackintosh |
| 5,813,456 | A | 9/1998 | Milner et al. |
| 5,836,395 | A | 11/1998 | Budde |
| 5,839,515 | A | 11/1998 | Yuan et al. |
| 5,850,877 | A | 12/1998 | Albright et al. |
| 5,907,664 | A | 5/1999 | Wang et al. |
| 5,909,768 | A | 6/1999 | Castille et al. |
| 5,971,086 | A | 10/1999 | Bee et al. |
| 5,984,007 | A | 11/1999 | Yuan et al. |
| 5,988,273 | A | 11/1999 | Monjure et al. |
| 6,056,060 | A | 5/2000 | Abrahamsen et al. |
| 6,070,500 | A | 6/2000 | Dlask et al. |
| 6,079,498 | A | 6/2000 | Lima et al. |
| 6,079,509 | A | 6/2000 | Bee et al. |
| 6,142,545 | A | 11/2000 | Penman et al. |
| 6,161,617 | A | 12/2000 | Gjedebo |
| 6,173,777 | B1 | 1/2001 | Mullins |
| 6,199,641 | B1 | 3/2001 | Downie et al. |
| 6,223,823 | B1 | 5/2001 | Head |
| 6,227,587 | B1 | 5/2001 | Terral |
| 6,275,938 | B1 | 8/2001 | Bond et al. |
| 6,290,432 | B1 | 9/2001 | Exley et al. |
| 6,305,469 | B1 | 10/2001 | Coenen et al. |
| 6,309,002 | B1 | 10/2001 | Bouligny |
| 6,311,792 | B1 | 11/2001 | Scott et al. |
| 6,349,764 | B1 | 2/2002 | Adams et al. |
| 6,360,633 | B2 | 3/2002 | Pietras |
| 6,367,566 | B1 | 4/2002 | Hill |
| 6,374,506 | B1 | 4/2002 | Clay |
| 6,374,706 | B1 | 4/2002 | Newman |
| 6,392,317 | B1 | 5/2002 | Hall et al. |
| 6,429,784 | B1 | 8/2002 | Beique et al. |
| 6,431,626 | B1 | 8/2002 | Bouligny |
| 6,443,241 | B1 | 9/2002 | Juhasz et al. |
| 6,446,723 | B1 | 9/2002 | Ramons et al. |
| 6,527,047 | B1 | 3/2003 | Pietras |
| 6,536,520 | B1 | 3/2003 | Snider et al. |
| 6,622,796 | B1 | 9/2003 | Pietras |
| 6,648,075 | B2 | 11/2003 | Badrak et al. |
| 6,688,394 | B1 | 2/2004 | Ayling |
| 6,691,801 | B2 | 2/2004 | Juhasz et al. |
| 6,698,595 | B2 | 3/2004 | Norell et al. |
| 6,725,938 | B1 | 4/2004 | Pietras |
| 6,742,596 | B2 | 6/2004 | Haugen |

| | | | |
|---|---|---|---|
| 6,742,606 | B2 | 6/2004 | Metcalfe et al. |
| 2002/0070842 | A1 | 6/2002 | Bailey et al. |
| 2002/0108748 | A1 | 8/2002 | Keyes |
| 2002/0170720 | A1 | 11/2002 | Haugen |
| 2003/0029641 | A1 | 2/2003 | Meehan |
| 2003/0056947 | A1 | 3/2003 | Cameron |
| 2003/0164250 | A1 | 9/2003 | Wardley |
| 2003/0164251 | A1 | 9/2003 | Tulloch |
| 2003/0173090 | A1 | 9/2003 | Cook et al. |
| 2003/0213598 | A1 | 11/2003 | Hughes |
| 2004/0000405 | A1 | 1/2004 | Fournier Jr. et al. |
| 2004/0001153 | A1 | 1/2004 | Simonds et al. |
| 2004/0003944 | A1 | 1/2004 | Vincent et al. |
| 2004/0060697 | A1 | 4/2004 | Tilton et al. |
| 2004/0069500 | A1 | 4/2004 | Haugen |
| 2004/0079533 | A1 | 4/2004 | Buytaert et al. |
| 2004/0108142 | A1 | 6/2004 | Vail III. |
| 2004/0112646 | A1 | 6/2004 | Vail |
| 2004/0118613 | A1 | 6/2004 | Vail |
| 2004/0123984 | A1 | 7/2004 | Vail |
| 2004/0124015 | A1 | 7/2004 | Vail et al. |
| 2004/0129456 | A1 | 7/2004 | Vail |
| 2004/0140128 | A1 | 7/2004 | Vail |
| 2004/0173358 | A1 | 9/2004 | Haugen |
| 2004/0216925 | A1 | 11/2004 | Metcalfe et al. |

FOREIGN PATENT DOCUMENTS

| | | |
|---|---|---|
| EP | 0 171 144 | 2/1986 |
| EP | 0 285 386 | 10/1988 |
| EP | 0 426 123 | 5/1991 |
| EP | 0 474 481 | 3/1992 |
| EP | 0 525 247 | 2/1993 |
| EP | 0 589 823 | 3/1994 |
| EP | 0 659 975 | 6/1995 |
| EP | 0 790 386 | 8/1997 |
| EP | 0 881 354 | 4/1998 |
| EP | 0 962 384 | 12/1999 |
| EP | 1 256 691 | 11/2002 |
| FR | 2741907 | 6/1997 |
| FR | 2 841 293 | 12/2003 |
| GB | 709 365 | 5/1954 |
| GB | 716 761 | 10/1954 |
| GB | 881 358 | 11/1961 |
| GB | 2 115 940 | 9/1983 |
| GB | 2 224 481 | 9/1990 |
| GB | 2 275 486 | 4/1993 |
| GB | 2 294 715 | 8/1996 |
| GB | 2 349 401 | 11/2000 |
| GB | 2 350 137 | 11/2000 |
| GB | 2 357 530 | 6/2001 |
| GB | 2 352 747 | 7/2001 |
| GB | 2 372 765 | 9/2002 |
| RU | 2 079 633 | 5/1997 |
| WO | WO 93/07358 | 4/1993 |
| WO | WO 96/18799 | 6/1996 |
| WO | WO 98/05844 | 2/1998 |
| WO | WO 98/11322 | 3/1998 |
| WO | WO 98/32948 | 7/1998 |
| WO | WO 99/35368 | 7/1999 |
| WO | WO 99/41485 | 8/1999 |
| WO | WO 99/58810 | 11/1999 |
| WO | WO 00/39429 | 7/2000 |
| WO | WO 00/39430 | 7/2000 |
| WO | WO 00/46484 | 8/2000 |
| WO | WO 00/66879 | 11/2000 |
| WO | WO 02/44601 | 6/2002 |
| WO | WO 02/081863 | 10/2002 |
| WO | WO 03/087525 | 10/2003 |

OTHER PUBLICATIONS

The Original Portable Top Drive Drilling System, TESCO Drilling Technology, 1997.

Mike Killalea, Portable Top Drives: What's Driving The Marked?, IADC, Drilling Contractor, Sep. 1994, 4 Pages.

500 or 650 ECIS Top Drive, Advanced Permanent Magnet Motor Technology, TESCO Drilling Technology, Apr. 1998, 2 Pages.

500 or 650 HCIS Top Drive, Powerful Hydraulic Compact Top Drive Drilling System, TESCO Drilling Technology, Apr. 1998, 2 Pages.

Product Information (Sections 1–10) CANRIG Drilling Technology, Ltd., Sep. 18, 1996.

APPARATUS AND METHODS FOR TUBULAR MAKEUP INTERLOCK

CROSS-REFERENCE TO RELATED APPLICATIONS

This application is a divisional of U.S. patent application Ser. No. 09/860,127, filed May 17, 2001, now U.S. Pat. No. 6,742,596 which application is incorporated herein by reference.

BACKGROUND OF THE INVENTION

1. Field of the Invention

The present invention relates to an apparatus and methods for facilitating the connection of tubulars. More particularly, the invention relates to an interlock system for a top drive and a spider for use in assembling or disassembling tubulars.

2. Background of the Related Art

In the construction and completion of oil or gas wells, a drilling rig is constructed on the earth's surface to facilitate the insertion and removal of tubular strings into a wellbore. The drilling rig includes a platform and power tools such as an elevator and a spider to engage, assemble, and lower the tubulars into the wellbore. The elevator is suspended above the platform by a draw works that can raise or lower the elevator in relation to the floor of the rig. The spider is mounted in the platform floor. The elevator and spider both have slips that are capable of engaging and releasing a tubular, and are designed to work in tandem. Generally, the spider holds a tubular or tubular string that extends into the wellbore from the platform. The elevator engages a new tubular and aligns it over the tubular being held by the spider. A power tong and a spinner are then used to thread the upper and lower tubulars together. Once the tubulars are joined, the spider disengages the tubular string and the elevator lowers the tubular string through the spider until the elevator and spider are at a predetermined distance from each other. The spider then re-engages the tubular string and the elevator disengages the string and repeats the process. This sequence applies to assembling tubulars for the purpose of drilling a wellbore, running casing to line the wellbore, or running wellbore components into the well. The sequence can be reversed to disassemble the tubular string.

During the drilling of a wellbore, a drill string is made up and is then necessarily rotated in order to drill. Historically, a drilling platform includes a rotary table and a gear to turn the table. In operation, the drill string is lowered by an elevator into the rotary table and held in place by a spider. A Kelly is then threaded to the string and the rotary table is rotated, causing the Kelly and the drill string to rotate. After thirty feet or so of drilling, the Kelly and a section of the string are lifted out of the wellbore, and additional drill string is added.

The process of drilling with a Kelly is expensive due to the amount of time required to remove the Kelly, add drill string, reengage the Kelly, and rotate the drill string. In order to address these problems, top drives were developed.

For example, International Application Number PCT/GB99/02203, published on Feb. 3, 2000 discloses apparatus and methods for connecting tubulars using a top drive. In another example, FIG. 1 shows a drilling rig 100 configured to connect and run casings into a newly formed wellbore 180 to line the walls thereof. As shown, the rig 100 includes a top drive 200, an elevator 120, and a spider 400. The rig 100 is built at the surface 170 of the well. The rig 100 is built at the surface 170 of the well. The rig 100 includes a traveling block 110 that is suspended by wires 150 from draw works 105 and holds the top drive 200. The top drive 200 has a gripping means 301 for engaging the inner wall of the casing 15 and a motor 240 to rotate the casing 15. The motor 240 may rotate and thread the casing 15 into the casing string 16 held by the spider 400. The gripping means 301 facilitate the engagement and disengagement of the casing 15 without having to thread and unthread the casing 15 to the top drive 200. Additionally, the top drive 200 is coupled to a railing system 140. The railing system 140 prevents the top drive 200 from rotational movement during rotation of the casing string 16, but allows for vertical movement of the top drive 200 under the traveling block 110.

In FIG. 1, the top drive 200 is shown engaged to casing 15. The casing 15 is placed in position below the top drive 200 by the elevator 120 in order for the top drive 200 to engage the casing 15. Additionally, the spider 400, disposed on the platform 160, is shown engaged around a casing string 16 that extends into wellbore 180. Once the casing 15 is positioned above the casing string 16, the top drive 200 can lower and thread the casing 15 into the casing string 16, thereby extending the length of the casing string 16. Thereafter, the extended casing string 16 may be lowered into the wellbore 180.

FIG. 2 illustrates the top drive 200 engaged to the casing string 16 after the casing string 16 has been lowered through a spider 400. The spider 400 is shown disposed on the platform 160. The spider 400 comprises a slip assembly 440 including a set of slips 410 and piston 420. The slips 410 are wedge-shaped and constructed and arranged to slidably move along a sloped inner wall of the slip assembly 440. The slips 410 are raised or lowered by the piston 420. When the slips 410 are in the lowered position, they close around the outer surface of the casing string 16. The weight of the casing string 16 and the resulting friction between the casing string 16 and the slips 410 force the slips downward and inward, thereby tightening the grip on the casing string 16. When the slips 410 are in the raised position as shown, the slips 410 are opened and the casing string 16 is free to move axially in relation to the slips 410.

FIG. 3 is cross-sectional view of a top drive 200 and a casing 15. The top drive 200 includes a gripping means 301 having a cylindrical body 300, a wedge lock assembly 350, and slips 340 with teeth (not shown). The wedge lock assembly 350 and the slips 340 are disposed around the outer surface of the cylindrical body 300. The slips 340 are constructed and arranged to mechanically grip the inside of the casing 15. The slips 340 are threaded to piston 370 located in a hydraulic cylinder 310. The piston 370 is actuated by pressurized hydraulic fluid injected through fluid ports 320, 330. Additionally, springs 360 are located in the hydraulic cylinder 310 and are shown in a compressed state. When the piston 370 is actuated, the springs 360 decompress and assist the piston 370 in moving the slips 340 relative to the cylindrical body 300. The wedge lock assembly 350 is connected to the cylindrical body 300 and constructed and arranged to force the slips 340 against the inner wall of the casing 15.

In operation, the slips 340, and the wedge lock assembly 350 of top drive 200 are lowered inside the casing 15. Once the slips 340 are in the desired position within the casing 15, pressurized fluid is injected into the piston 370 through fluid port 320. The fluid actuates the piston 370, which forces the slips 340 towards the wedge lock assembly 350. The wedge lock assembly 350 functions to bias the slips 340 outwardly as the slips 340 are slidably forced along the outer surface of the assembly 350, thereby forcing the slips 340 to engage the inner wall of the casing 15.

FIG. 4 illustrates a cross-sectional view of a top drive 200 engaged to the casing 15. Particularly, the figure shows the slips 340 engaged with the inner wall of the casing 15 and a spring 360 in the decompressed state. In the event of a hydraulic fluid failure, the springs 360 can bias the piston 370 to keep the slips 340 in the engaged position, thereby providing an additional safety feature to prevent inadvertent release of the casing string 16. Once the slips 340 are engaged with the casing 15, the top drive 200 can be raised along with the cylindrical body 300. By raising the body 300, the wedge lock assembly 350 will further bias the slips 340 outward. With the casing 15 retained by the top drive 200, the top drive 200 may relocate the casing 15 to align and thread the casing 15 with casing string 16.

In another embodiment (not shown), a top drive includes a gripping means for engaging a casing on the outer surface. For example, the slips of the gripping means can be arranged to grip on the outer surface of the casing, preferably gripping under the collar of the casing. In operation, the top drive is positioned over the desired casing. The slips are then lowered by the top drive to engage the collar of the casing. Once the slips are positioned beneath the collar, the piston is actuated to cause the slips to grip the outer surface of the casing.

FIG. 5 is a flow chart illustrating a typical operation of running casing using a top drive 200 and a spider 400. The flow chart relates to the operation of an apparatus generally illustrated in FIG. 1. At a first step 500, a casing string 16 is retained in a closed spider 400 and is thereby prevented from moving in an axial direction. At step 510, top drive 200 is moved to engage a casing 15 with the aid of an elevator 120. Engagement of the casing 15 by the top drive 200 includes grasping the casing 15 and engaging the inner surface thereof. At step 520, the top drive 200 moves the casing 15 into position above the casing string 16 for connection therewith. At step 530, the top drive 200 threads the casing 15 to casing string 16. At step 540, the spider 400 is opened and disengages the casing string 16. At step 550, the top drive 200 lowers the extended casing string 16 through the opened spider 400. At step 560, the spider 400 is closed around the casing string 16. At step 570, the top drive 200 disengages the casing string 16 and can proceed to add another casing 15 to the casing string 16 as in step 510. The above-described steps may be utilized to run drill string in a drilling operation, to run casing to reinforce the wellbore, or to assemble run-in strings to place wellbore components in the wellbore. The steps may also be reversed in order to disassemble a tubular string.

Although the top drive is a good alternative to the Kelly and rotary table, the possibility of inadvertently dropping a casing string into the wellbore exists. As noted above, a top drive and spider must work in tandem, that is, at least one of them must engage the casing string at any given time during casing assembly. Typically, an operator located on the platform controls the top drive and the spider with manually operated levers that control fluid power to the slips that cause the top drive and spider to retain a casing string. At any given time, an operator can inadvertently drop the casing string by moving the wrong lever. Conventional interlocking systems have been developed and used with elevator/spider systems to address this problem, but there remains a need for a workable interlock system usable with a top drive/spider system such as the one described herein.

There is a need therefore, for an interlock system for use with a top drive and spider to prevent inadvertent release of a tubular string. There is a further need for an interlock system to prevent the inadvertent dropping of a tubular or tubular string into a wellbore. There is also a need for an interlock system that prevents a spider or a top drive from disengaging a tubular string until the other component has engaged the tubular.

SUMMARY OF THE INVENTION

The present invention generally provides an apparatus and methods to prevent inadvertent release of a tubular or tubular string. In one aspect, the apparatus and methods disclosed herein ensure that either the top drive or the spider is engaged to the tubular before the other component is disengaged from the tubular. The interlock system is utilized with a spider and a top drive during assembly of a tubular string.

In another aspect, the present invention provides an apparatus for use with tubulars. The apparatus includes a first device for gripping and joining the tubulars, a second device for gripping the tubulars, and an interlock system to ensure that the tubulars are gripped by at least one of the first or second device.

In another aspect still, the present invention provides a method for assembling and dissembling tubulars. The method includes joining a first tubular engaged by a first apparatus to a second tubular engaged by a second apparatus thereby forming a tubular string. An interlock system is provided to ensure that at least one of the first apparatus or the second apparatus is engaging the tubular string. After the tubulars are joined, the second apparatus is opened to disengage the string, thereby allowing the tubular string to be lowered through the second apparatus. After the string is repositioned, the second apparatus is actuated to reengage the tubular string. After the second apparatus secures the tubular string, the first apparatus is disengaged from the string.

In another aspect still, the first apparatus includes a gripping member for engaging the tubular. In one aspect, the gripping member is movably coupled to the first apparatus. Particularly, the gripping member may pivot relative to the first apparatus to facilitate engagement with the tubular. In one embodiment, a swivel is used to couple the gripping member to the first apparatus.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore, not to be considered limiting of its scope, for the invention may admit to other equally effective embodiments.

DETAILED DESCRIPTION OF THE PREFERRED EMBODIMENT

The present invention is an interlock system for use with a top drive and a spider during assembly of a string of tubulars. The invention may be utilized to assemble tubulars for different purposes including drill strings, strings of liner and casing and run-in strings for wellbore components.

Figure 1:
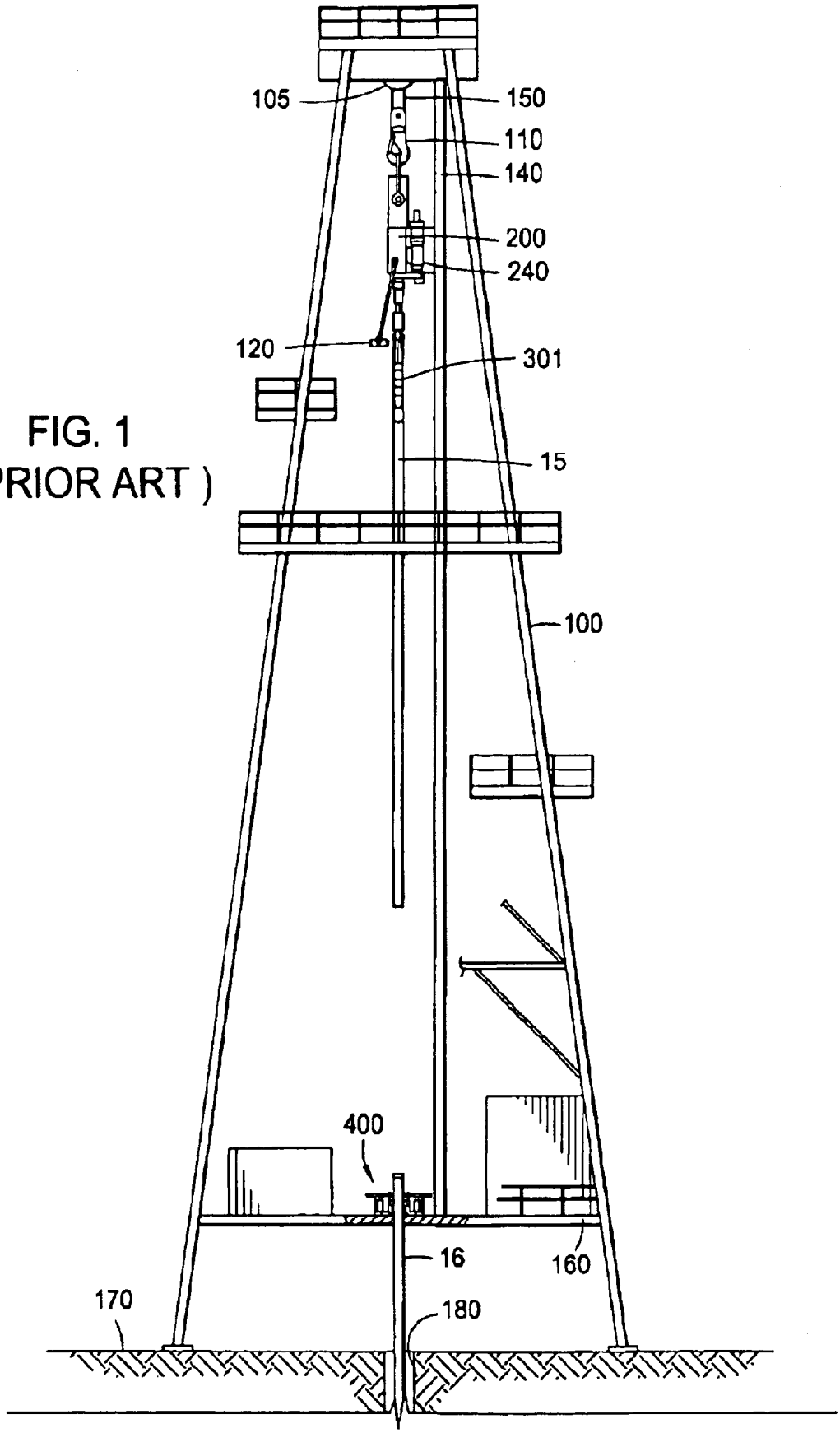
FIG. 1 ( PRIOR ART )
FIG. 1 shows a rig having a top drive and an elevator configured to connect tubulars.
Figure 2:
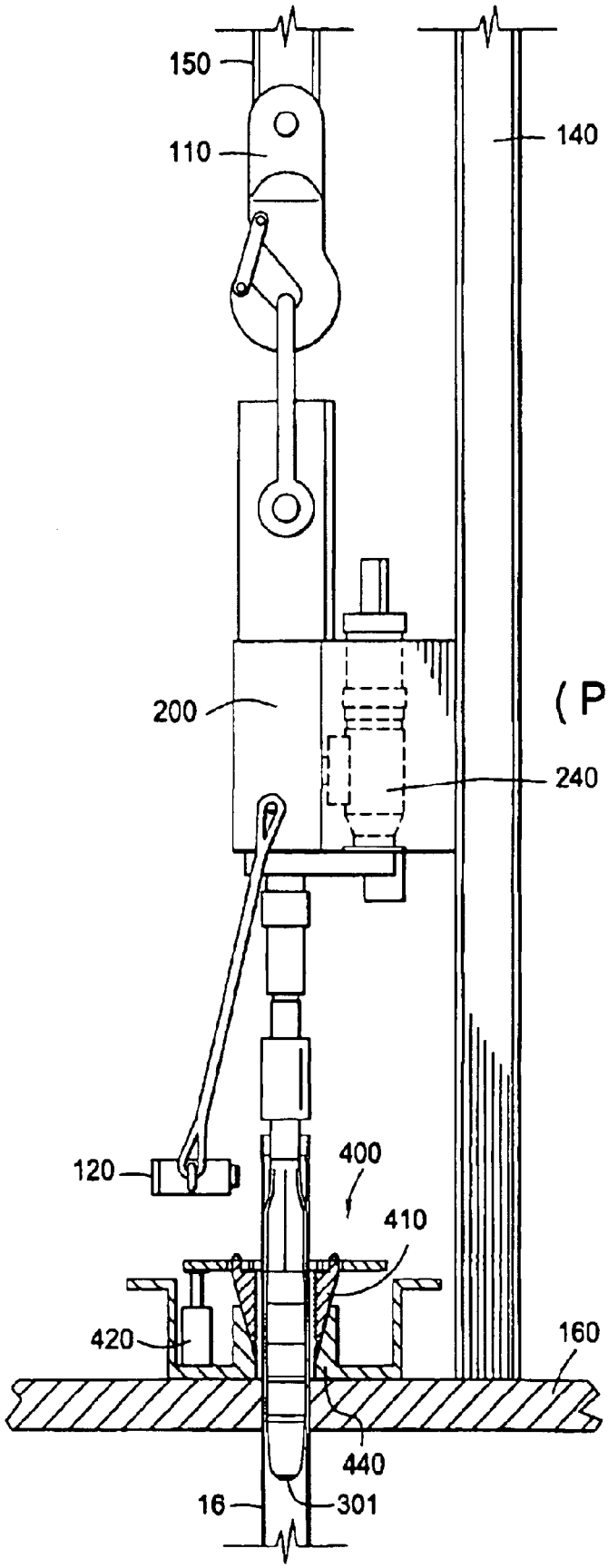
FIG. 2 ( PRIOR ART )
FIG. 2 illustrates the top drive engaged to a tubular that has been lowered through a spider.
Figure 3:
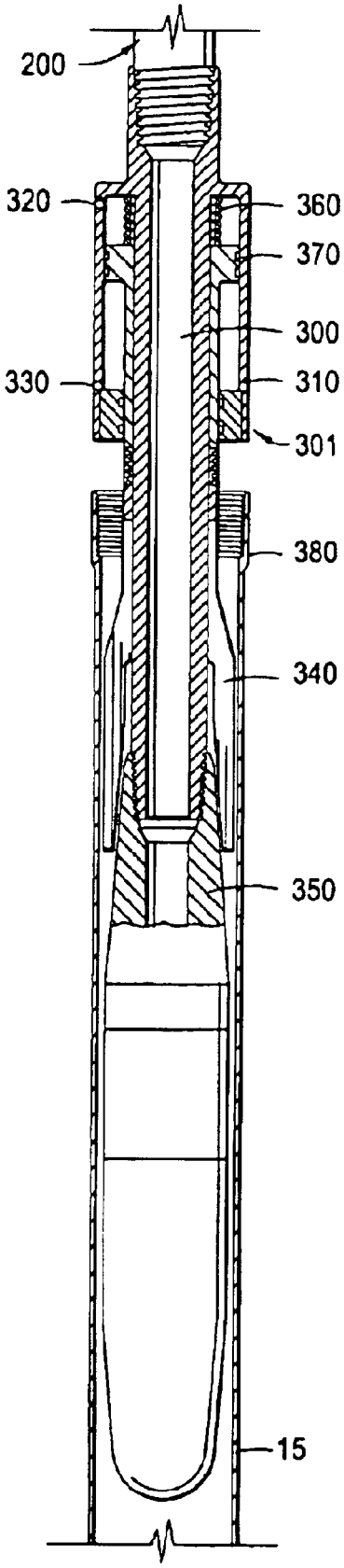
FIG. 3 is a cross-sectional view of a gripping member for use with a top drive for handling tubulars in the un-engaged position.
Figure 4:
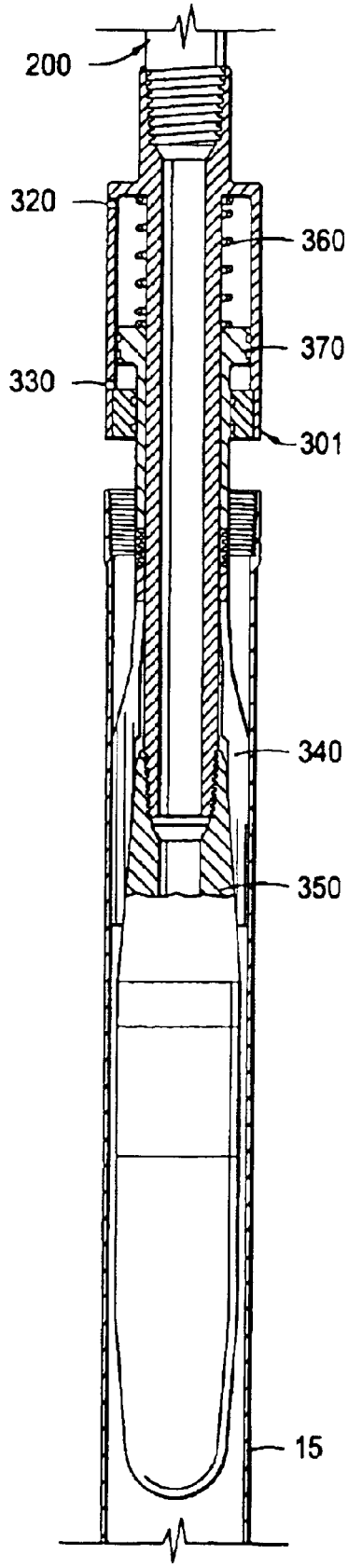
FIG. 4 is a cross-sectional view of the gripping member of FIG. 3 in the engaged position.
Figure 5:
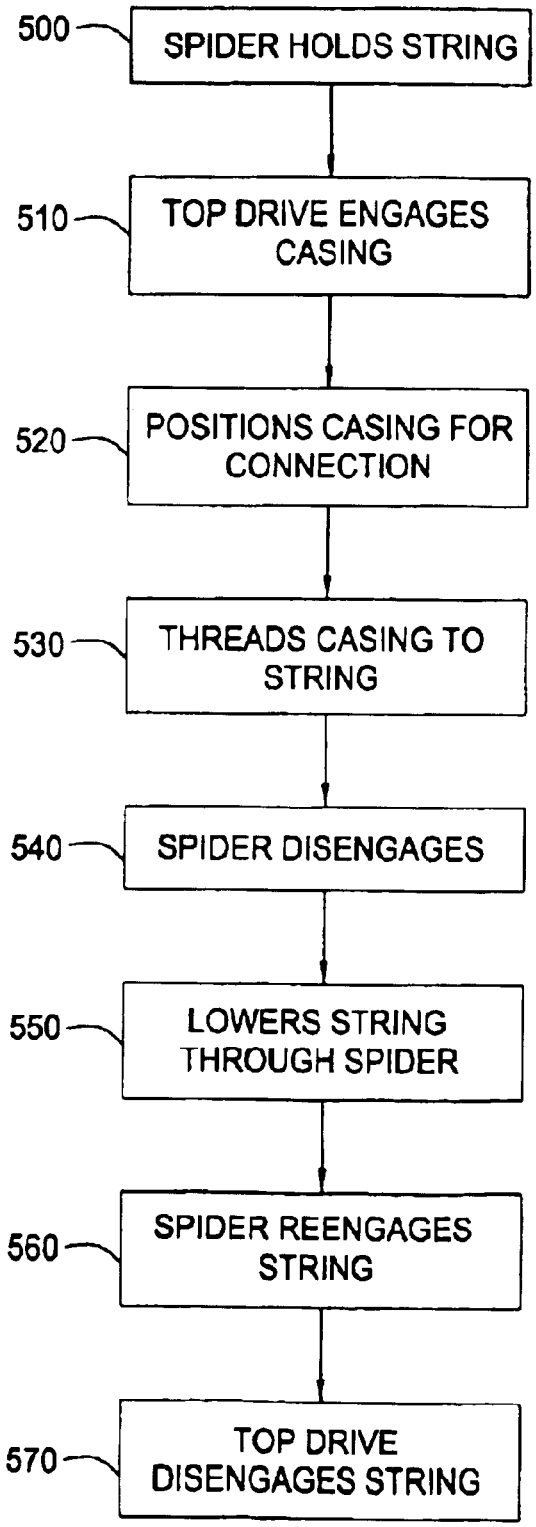
FIG. 5 is a flow chart for connecting tubulars using a top drive and a spider.
Figure 6:
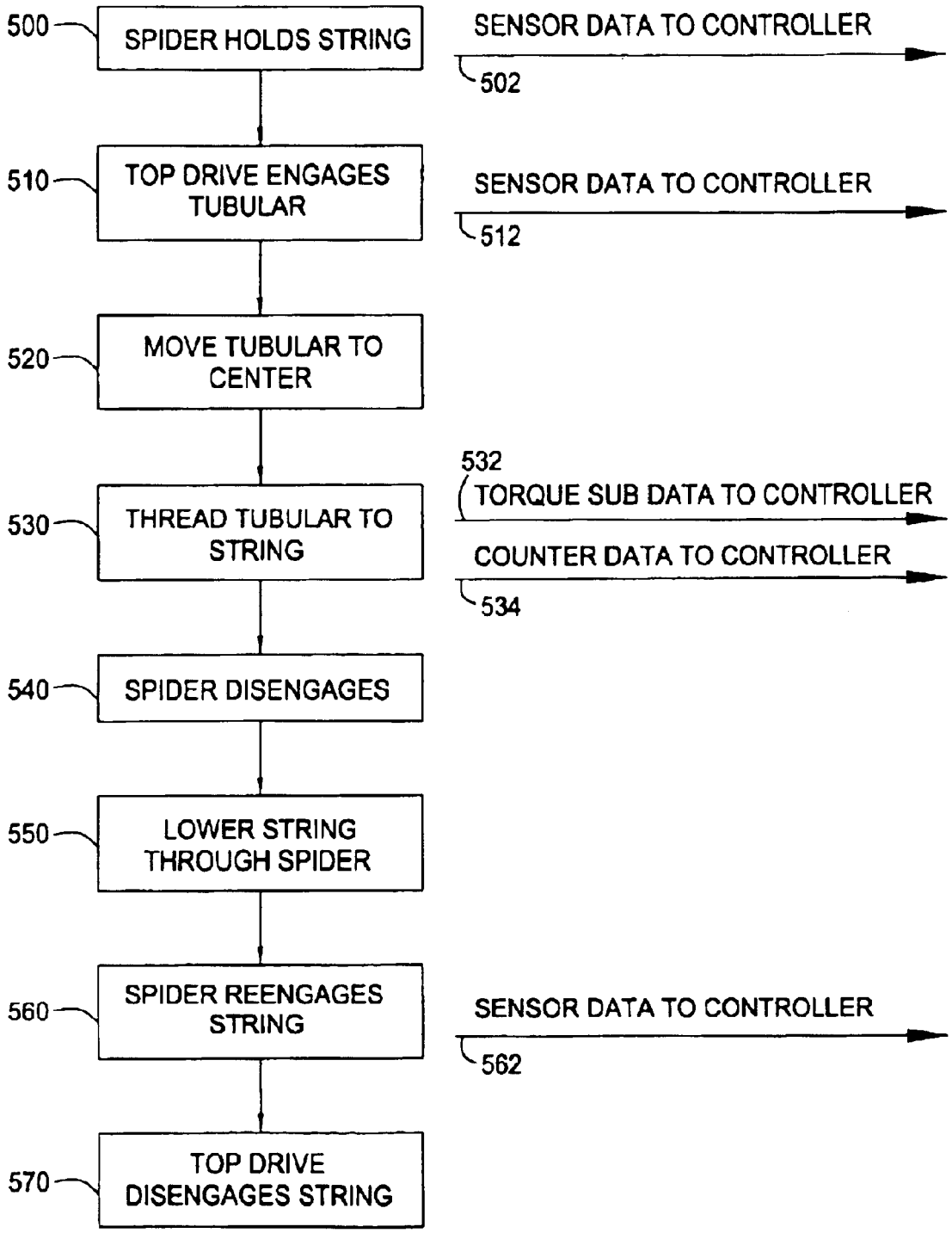
FIG. 6 shows a flow chart for connecting tubulars using an interlock system for a spider and a top drive according to aspects of the present invention.
Figure 8:
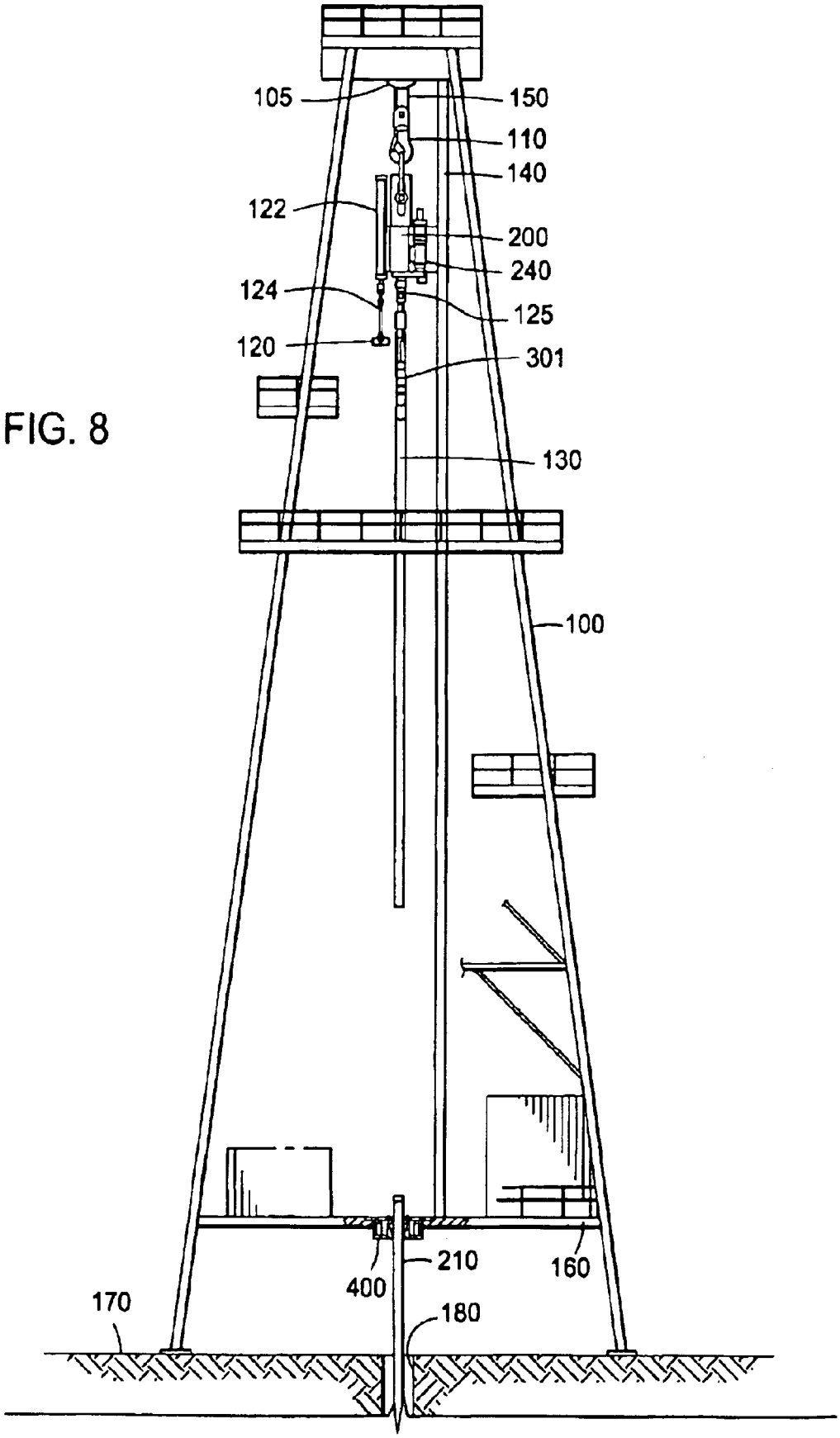
FIG. 8 illustrates the top drive of FIG. 7 after it has engaged the tubular.
Figure 10:
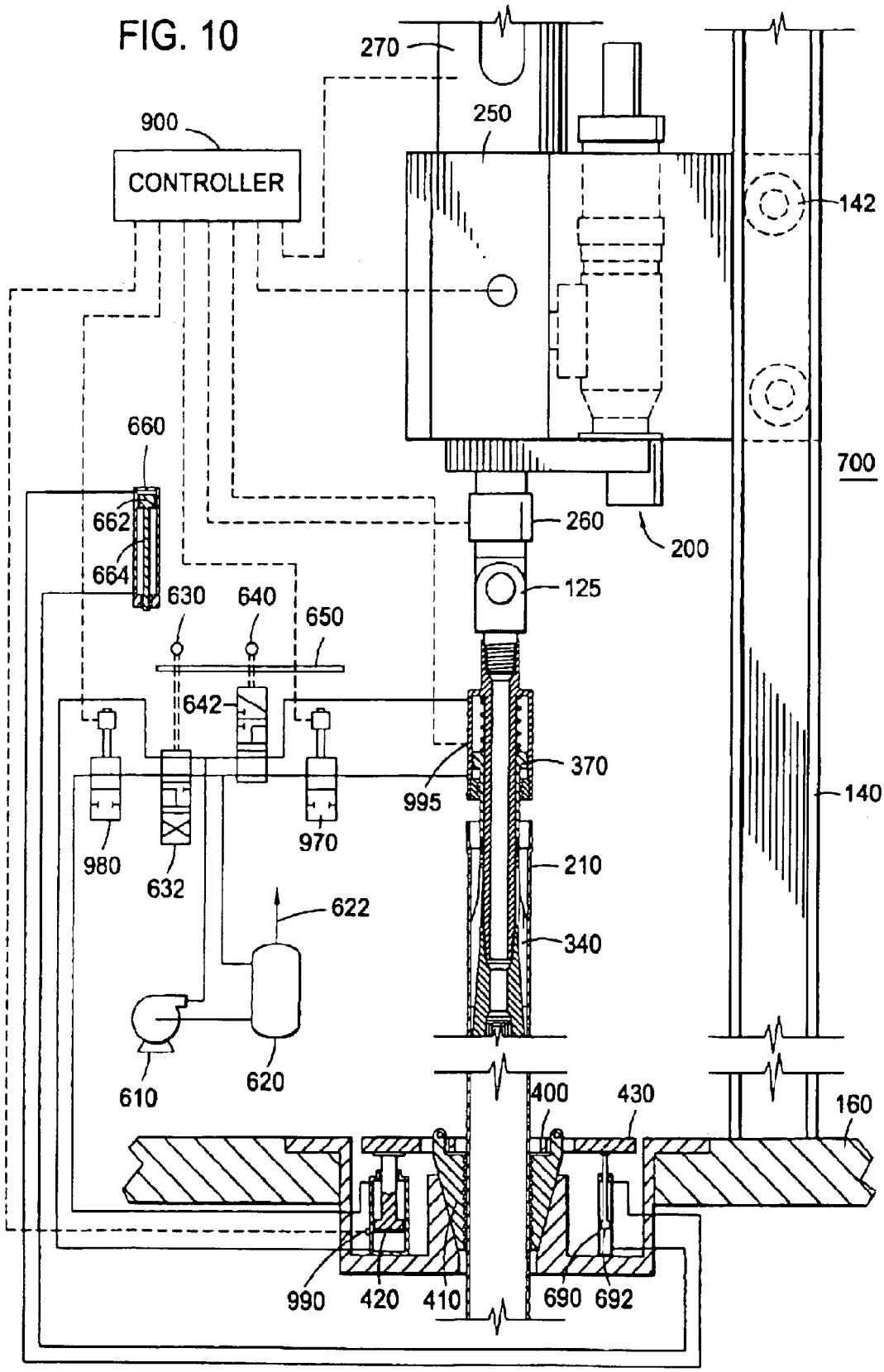
FIG. 10 illustrates the mechanics of the interlock system in use with a spider, a top drive and a controller according to aspects of the present invention.

FIG. 6 is a flow chart illustrating the use of an interlock system 700 of the present invention with a spider 400 and a top drive 200, and FIG. 10 illustrates the mechanics of the interlock system 700 in use with a spider 400, a top drive 200, and a controller 900. At step 500, a casing string 210 is retained in a closed spider 400 and prevented from moving in an axial direction, as illustrated in FIG. 8. In one embodiment, the spider 400 is a flush mounted spider that is disposed in the platform 160. Referring to FIG. 10, the spider 400 includes a spider piston sensor 990 located at a spider piston 420 to sense when the spider 400 is open or closed around the casing string 210. The sensor data 502 is relayed to a controller 900.

A controller 900 includes a programmable central processing unit that is operable with a memory, a mass storage device, an input control unit, and a display unit. Additionally, the controller 900 includes well-known support circuits such as power supplies, clocks, cache, input/output circuits and the like. The controller 900 is capable of receiving data from sensors and other devices and capable of controlling devices connected to it.

One of the functions of the controller 900 is to prevent opening of the spider 400. Preferably, the spider 400 is locked in the closed position by a solenoid valve 980 that is placed in the control line between the manually operated spider control lever 630 and the source of fluid power operating the spider 400. Specifically, the spider solenoid valve 980 controls the flow of fluid to the spider piston 420. The solenoid valve 980 is operated by the controller 900, and the controller 900 is programmed to keep the valve 980 closed until certain conditions are met. While valve 980 is electrically powered in the embodiment described herein, the valve 980 could be fluidly or pneumatically powered so long as it is controllable by the controller 900. Typically, the valve 980 is closed and the spider 400 is locked until a tubular 130 is successfully joined to the string 210 and held by the top drive 200.

At step 510, the top drive 200 is moved to engage a casing 130. Referring back to FIG. 7, the elevator 120 is coupled to the top drive 200 using a piston and cylinder assembly 122 and a pair of bails 124. The piston and cylinder assembly 122 may serve to axially translate the elevator 120 relative to the gripping means 301 of the top drive 200. As shown, the gripping means 301, also known as a gripping head, is an internal gripping apparatus, wherein it may be inserted into the casing 130 to engage an interior surface thereof. In one embodiment, a pivotable mechanism 125 is employed to facilitate the engagement of the gripping means 301 to the casing 130. An example of a suitable pivotable mechanism 125 includes a swivel 125 having a first portion 125A pivotable relative to a second portion 125B. The swivel 125 couples the gripping means 301 to the top drive 200 and allows the gripping means 301 to move or pivot relative thereto. Particularly, first and second portions 125A, 125B include connections means for connecting to the top drive 200 and the gripping means 301, respectively. Preferably, the pivotable mechanism 125 includes a bore therethrough for fluid communication between the top drive 200 and the gripping means 301.

Figure 7:
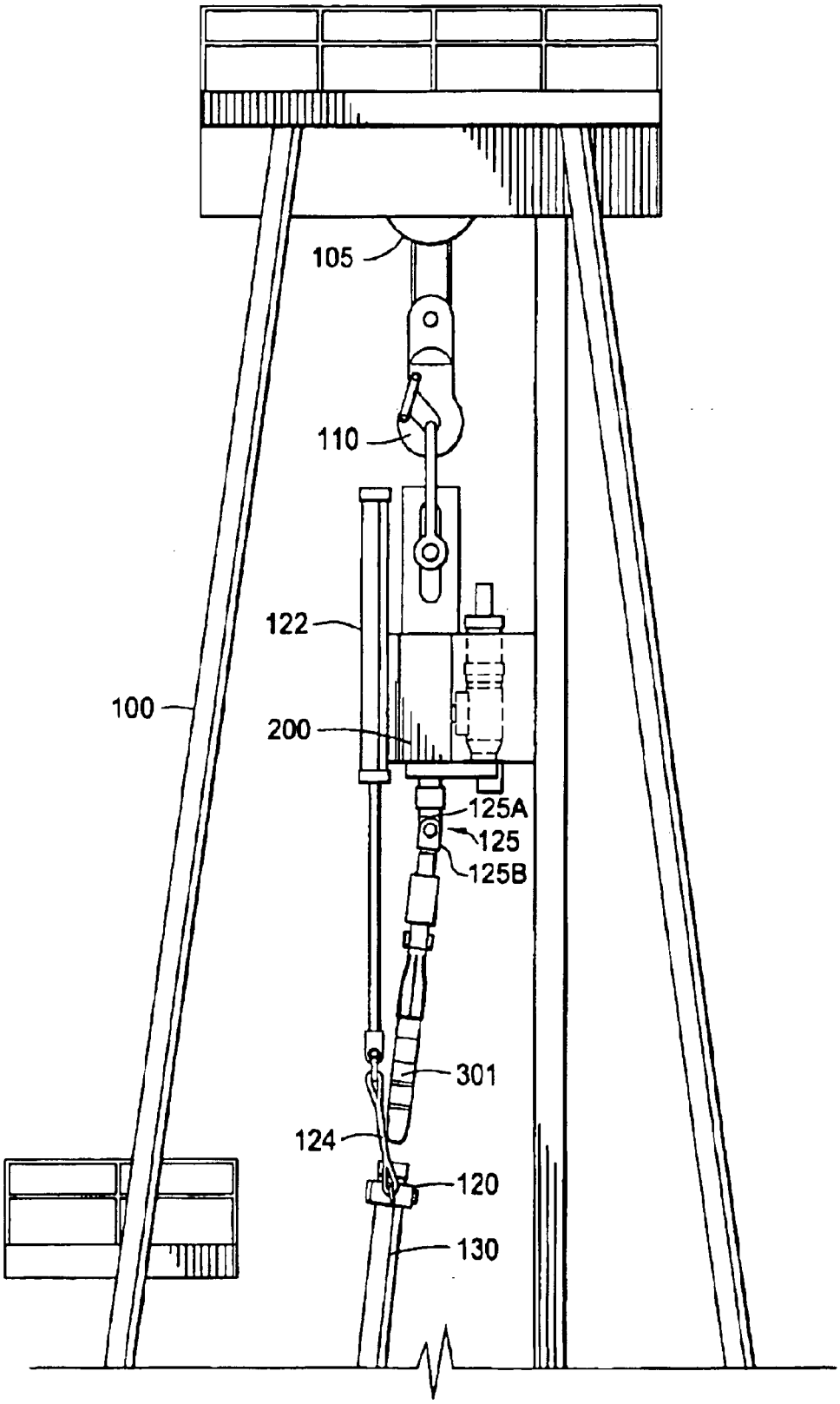
FIG. 7 illustrates an apparatus for connecting tubulars according to aspects of the present invention. The top drive is shown before it has engaged the tubular.

To engage the casing 130, the piston and cylinder assembly 122 is actuated to position the elevator 120 proximate the casing 130. The elevator 120 is then disposed around the casing 130. The movable bails 124 allow the casing 130 to tilt toward the well center. Thereafter, the gripping means 301 may be pivoted into alignment with the casing 130 for insertion thereof. Particularly, the swivel 125 is actuated to pivot the gripping means 301 as illustrated in FIG. 7. Once aligned, the gripping means 301 is inserted into the casing 130, and the slips 340 are actuated to engage the interior of the casing 130.

In one aspect, a top drive sensor 995 (FIG. 10) is placed near a top drive piston 370 to determine whether the gripping means 301 is engaged with the casing 130. The sensor data 512 is relayed to the controller 900 for processing.

At step 520, the top drive 200 moves the casing 130 into position above the casing string 210. Particularly, the swivel 125 is actuated to pivot the gripping means 301 toward the well center. In turn, the casing 130 is also positioned proximate the well center, and preferably, into alignment with the casing string 210 in the spider 400. Additionally, the traveling block 110 is actuated to lift the top drive 200 and the attached casing 130. In this manner, the casing 130 is aligned with the casing string 210 in the spider 400, as illustrated in FIG. 8.

At step 530, the top drive 200 rotationally engages the casing 130 to the casing string 210, thereby creating a threaded joint therebetween. In one embodiment, the top drive 200 may include a counter 250. The counter 250 is constructed and arranged to measure the rotation of the casing 130 during the make up process. The top drive 200 may also be equipped with a torque sub 260 to measure the amount of torque placed on the threaded connection. Torque data 532 from the torque sub 260 and rotation data 534 from the counter 250 are sent to the controller 900 for processing. The controller 900 is preprogrammed with acceptable values for rotation and torque for a particular connection. The controller 900 compares the rotation data 534 and the torque data 532 from the actual connections and determines if they are within the accepted values. If not, then the spider 400 remains locked and closed, and the casing 130 can be re-threaded or some other remedial action can take place by sending a signal to an operator. If the values are acceptable, the controller 900 locks the top drive 200 in the engaged position via a top drive solenoid valve 970 (FIG. 10) that prevents manual control of the top drive 200.

Figure 9:
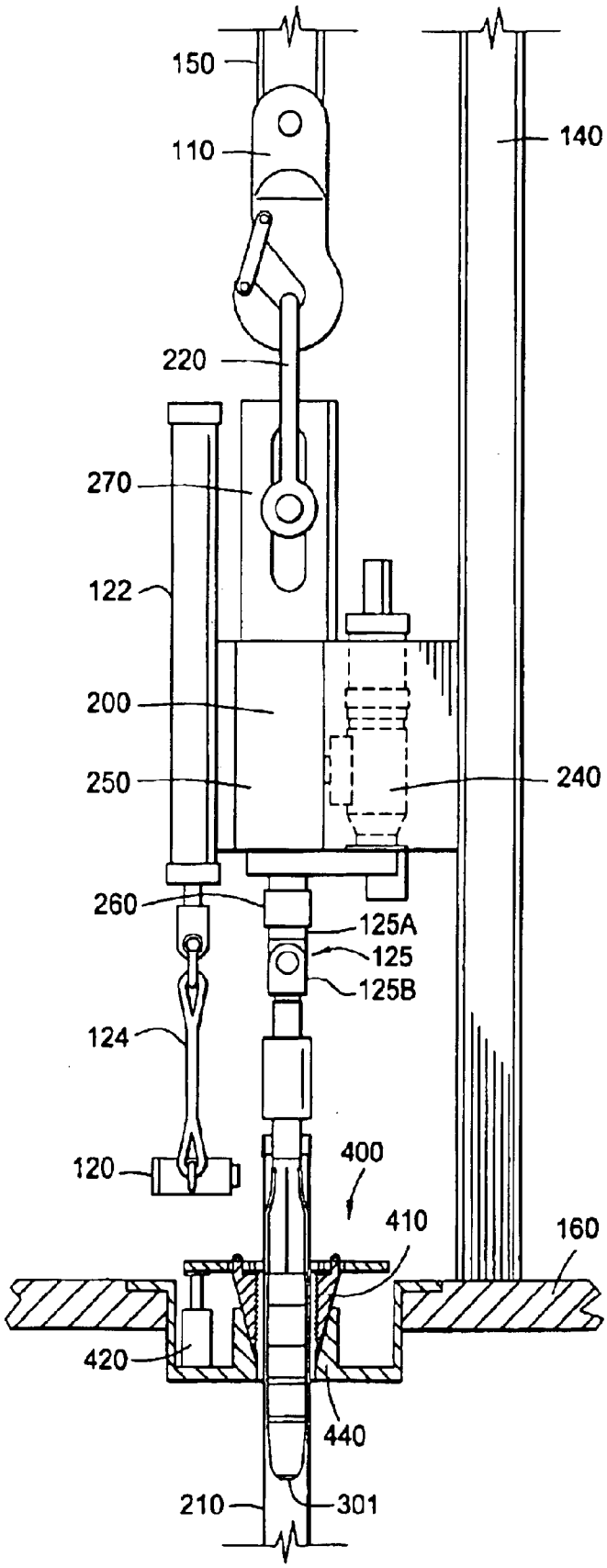
FIG. 9 illustrates the top drive of FIG. 7 after it has lowered the tubular toward the rig floor.

At step 540, the controller 900 unlocks the spider 400 via the spider solenoid valve 980, and allows fluid to power the piston 420 to open the spider 400 and disengage it from the casing string 210. At step 550, the top drive 200 lowers the casing string 210, including casing 130, through the opened spider 400. FIG. 9 shows the casing 130 lowered by the top drive 200.

At step 560, the spider 400 is closed around the casing string 210. At step 562, the spider sensor 990 (FIG. 10) signals to the controller 900 that the spider 400 is closed. If a signal is received confirming that the spider 400 is closed, the controller 900 locks the spider 400 in the closed position, and unlocks the top drive 200. If no signal is received, the top drive 200 stays locked and engaged to casing string 210. At step 570, after a signal is received, the top drive 200 disengages the casing string 210 and may proceed to add another casing 130. In this manner, at least the top drive 200 or the spider 400 is engaging the casing string 210 at all times.

Alternatively, or in addition to the foregoing, a compensator 270 may be utilized to gather additional information about the joint formed between the tubular and the tubular string. In one aspect, the compensator 270 couples the top drive 200 to the traveling block 110. The compensator 270 may function similar to a spring to compensate for vertical movement of the top drive 200 during threading of the casing 130 to the casing string 210. The compensator 270, in addition to allowing incremental movement of the top drive 200 during threading together of the tubulars, may be used to ensure that a threaded joint has been made and that the tubulars are mechanically connected together. For example, after a joint has been made between the tubular and the tubular string, the top drive may be raised or pulled up. If a joint has been formed between the tubular and the string, the compensator will "stoke out" completely, due the weight of the tubular string therebelow. If however, a joint has not been formed between the tubular and the string due to some malfunction of the top drive or misalignment between a tubular and a tubular string therebelow, the compensator will stroke out only a partial amount due to the relatively little weight applied thereto by the single tubular or tubular stack. A stretch sensor located adjacent the compensator, can sense the stretching of the compensator 270 and can relay the data to a controller 900. Once the controller 900 processes the data and confirms that the top drive is engaged to a complete tubular string, the top drive 200 is locked in the engaged position, and the next step 540 can proceed. If no signal is received, then the spider 400 remains locked and a signal maybe transmitted by the controller to an operator. During this "stretching" step, the spider 400 is not required to be unlocked and opened. The spider 400 and the slips 410 are constructed and arranged to prevent downward movement of the string but allow the casing string 210 to be lifted up and moved axially in a vertical direction even though the spider is closed. When closed, the spider 400 will not allow the casing string 210 to fall through its slips 410 due to friction and the shaped of the teeth on the spider slips.

The interlock system 700 is illustrated in FIG. 10 with the spider 400, the top drive 200, and the controller 900 including various control, signal, hydraulic, and sensor lines. The top drive 200 is shown engaged to a casing string 210 and is coupled to a railing system 140. The railing system 140 includes wheels 142 allowing the top drive 200 to move axially. The spider 400 is shown disposed in the platform 160 and in the closed position around the casing string 210. The spider 400 and the top drive 200 may be pneumatically actuated, however the spider 400 and top drive 200 discussed herein are hydraulically activated. Hydraulic fluid is supplied to a spider piston 420 via a spider control valve 632. The spider control valve 632 is a three-way valve and is operated by a spider lever 630.

Also shown in FIG. 10 is a sensor assembly 690 with a piston 692 coupled to spider slips 410 to detect when the spider 400 is open or closed. The sensor assembly 690 is in communication with a locking assembly 660, which along with a control plate 650 prevents the movement of the spider 400 and top drive lever. The locking assembly 660 includes a piston 662 having a rod 664 at a first end. The rod 564 when extended, blocks the movement of the control plate 550 when the plate is in a first position. When the spider 400 is in the open position, the sensor assembly 690 communicates to the locking assembly 660 to move the rod 664 to block the control plate's 650 movement. When the spider 400 is in the closed position as shown, the rod 664 is retracted allowing the control plate 650 to move freely from the first to a second position. Additionally, the sensor assembly 660 can also be used with the top drive 200 as well in the same fashion. Similarly, hydraulic fluid is supplied to a top drive piston 370 via a top drive control valve 642 and hydraulic lines. The top drive control valve 642 is also a three-way valve and is operated by a top drive lever 640. A pump 610 is used to circulate fluid to the respective pistons 370, 420. A reservoir 620 is used to recirculate hydraulic fluid and receive excess fluid. Excess gas in the reservoir 620 is vented 622.

Further shown in FIG. 10, controller 900 collects data from a top drive sensor 995 regarding the engagement of the top drive to the casing string 210. Data regarding the position of the spider 400 is also provided to the controller 900 from a spider sensor 990. The controller 900 controls fluid power to the top drive 200 and spider 400 via solenoid valves 970, 980, respectively.

In FIG. 10, the top drive 200 is engaged to casing string 210 while the spider 400 is in the closed position around the same casing string 210. At this point, steps 500, 510, 520, and 530 of FIG. 6 have occurred. Additionally, the controller 900 has determined through the data received from counter 250 and torque sub 260 that an acceptable threaded joint has been made between casing 130 and casing string 210. In the alternative or in addition to the foregoing, a compensator 270 can also provide data to the controller 900 that a threaded joint has been made and that the casing 130 and the casing string 210 are mechanically connected together via a stretch sensor (not shown). The controller 900 then sends a signal to a solenoid valve 970 to lock and keep a top drive piston 370 in the engaged position within the casing string 210. Moving to step 540 (FIG. 6), the controller 900 can unlock the previously locked spider 400, by sending a signal to a solenoid valve 980. The spider 400 must be unlocked and opened in order for the top drive 200 to lower the casing string 210 through the spider 400 and into a wellbore. An operator (not shown) can actuate a spider lever 630 that controls a spider valve 632, to allow the spider 400 to open and disengage the casing string 210. When the spider lever 630 is actuated, the spider valve 632 allows fluid to be flow to spider piston 420 causing spider slips 410 to open. With the spider 400 opened, a sensor assembly 690 in communication with a locking assembly 660 will cause a rod 664 to block the movement of a control plate 650. Because the plate 650 will be blocked in the rightmost position, the top drive lever 640 is held in the locked position and will be unable to move to the open position.

As illustrated in FIG. 10, the interlock system 700 when used with the top drive 200 and the spider 400 prevents the operator from inadvertently dropping the casing string 210 into the wellbore. As disclosed herein, the casing string 210 at all times is either engaged by the top drive 200 or the spider 400. Additionally, the controller 900 may prevent operation of the top drive 200 under certain situations, even if the top drive control lever 640 is actuated. In another aspect, the interlock system 700 may include a control plate 650 to control the physical movement of levers 630, 640 between the open and closed positions, thereby preventing the operator from inadvertently actuating the wrong lever.

Figure 11:
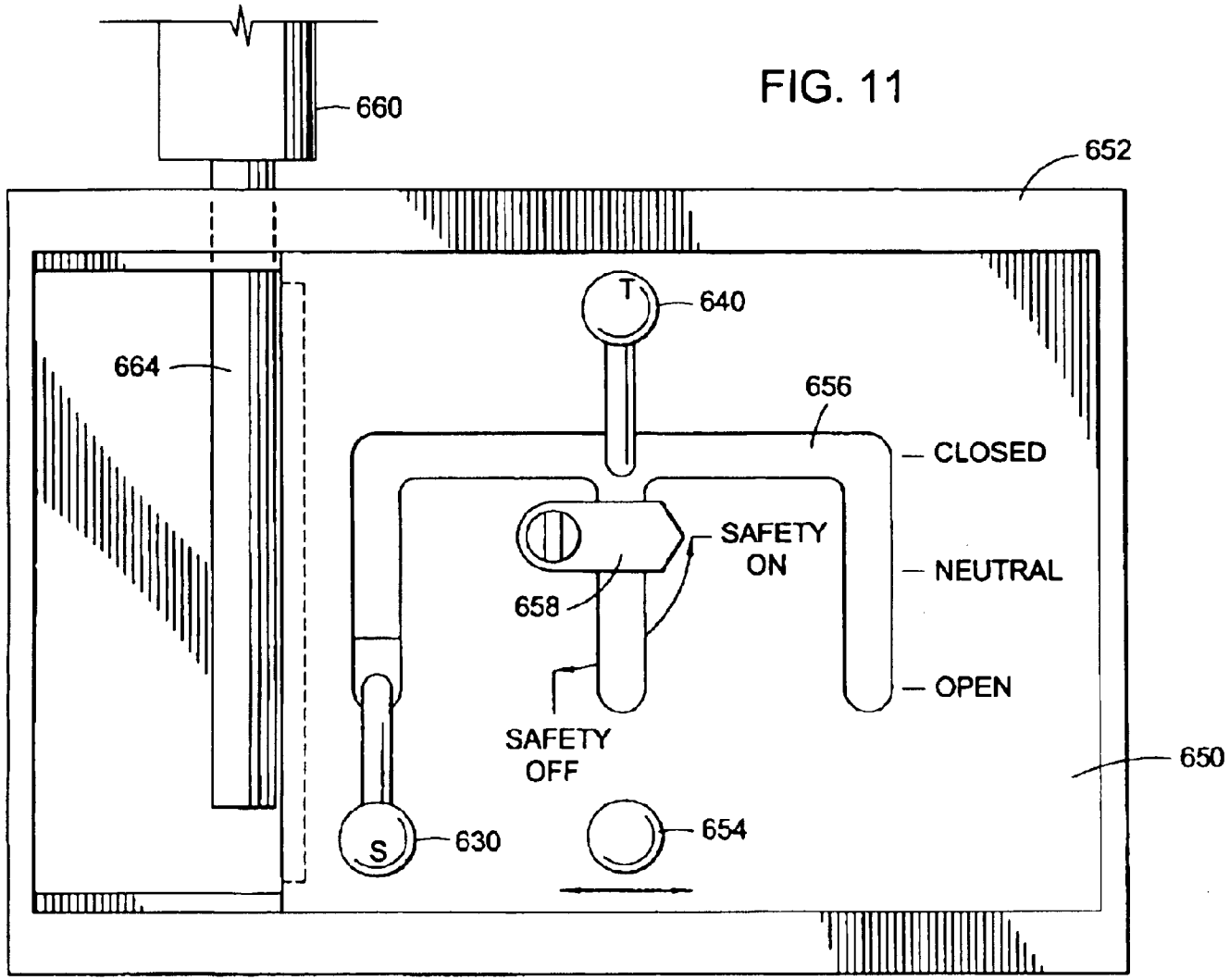
FIG. 11 illustrates a control plate for a spider lever and a top drive lever according to aspects of the present invention.

FIG. 11 illustrates a control plate 650 for a spider lever 630 and a top drive lever 640 that can be used with the interlock system 700 of the present invention. The control plate 650 is generally rectangular in shape and is provided with a series of slots 656 to control the movement of the spider lever 630, and the top drive lever 640. Typically, the control plate 650 is slideably mounted within a box 652. The slots 656 define the various positions in which the levers 630, 640 may be moved at various stages of the tubular assembly or disassembly. The levers 630, 640 can be moved in three positions: (1) a neutral position located in the center; (2) a closed position located at the top and causes the slips to close; and (3) an open position located at the bottom, which causes the slips to open. The control plate 650 can be moved from a first rightmost position to a second leftmost position with a knob 654. However, both levers 630, 640 must be in the closed position before the control plate is moved from one position to another. The control plate 650 is shown in the first rightmost position with a rod 664 extending from a locking assembly 660 to block the movement of the control plate. In operation, in the first rightmost position of the control plate 650, the spider lever 630 can be moved between the open and close positions, while the top drive lever 640 is kept in the closed position. In the second leftmost position, the top drive lever 640 can be moved between the open and close positions, while the spider lever 630 is kept in the closed position. A safety lock 658 is provided to allow the top drive or spider levers 630, 640 to open and override the control plate 650 when needed.

The interlock system 700 may be any interlock system that allows a set of slips to disengage only when another set of slips is engaged to the tubular. The interlock system 700 may be mechanically, electrically, hydraulically, pneumatically actuated systems. The spider 400 may be any spider that functions to hold a tubular or a tubular string at the surface of the wellbore. A top drive 200 may be any system thatincludes a gripping means for retaining a tubular by the inner or outer surface and can rotate the retained tubular. The gripping means may include an internal gripping apparatus such as a spear, an external gripping apparatus such as a torque head, or any other gripping apparatus for gripping a tubular as known to a person of ordinary skill in the art. For example, the external gripping apparatus may include a sensor for detecting information from its slips to ensure proper engagement of the casing. The top drive 200 can also be hydraulically or pneumatically activated.

While the foregoing is directed to the preferred embodiment of the present invention, other and further embodiments of the invention may be devised without departing from the basic scope thereof, and the scope thereof is determined by the claims that follow.

What is claimed is:

1. A method for assembling and disassembling tubulars, comprising:

joining a first tubular engaged by a top drive to a second tubular engaged by a spider, thereby forming a joint therebetween;

collecting data related to the formation of the joint;

comparing the data to preprogrammed values using a controller;

collecting data from the top drive and the spider via sensors to determine if they are engaging the tubulars;

opening the spider when predetermined conditions are met;

lowering the tubular string through the spider;

engaging the tubular string with the spider; and disengaging the tubular string with the top drive when predetermined conditions are met.

2. The method of claim 1, wherein collecting data related to the formation of the joint comprises collecting data related to torque applied.

3. The method of claim 1, wherein collecting data related to the formation of the joint comprises collecting data related to revolutions completed.

4. The method of claim 1, wherein collecting data related to the formation of the joint comprises collecting data related to axial movement.

5. The method of claim 1, wherein collecting data related to the formation of the joint comprises collecting data related to torque and revolutions.

6. A method of connecting tubulars, comprising:

closing a gripping member around a first tubular;

engaging a second gripping member of a top drive to a second tubular;

moving the second tubular to a well center;

threading the second tubular to the first tubular to form a joint and thereby a tubular string;

transmitting data from the second gripping member to a controller;

ensuring the second gripping member is engaged with the tubular string;

opening the first gripping member;

lowering the tubular string through the first gripping member;

closing the first gripping member around the tubular string; and disengaging the second gripping member from the tubular string.

7. The method of claim 6, wherein closing a first gripping member around a first tubular further comprises locking the first gripping member in the closed position and sending a signal to the controller that the first gripping member is in the closed position.

8. The method of claim 6, wherein transmitting data comprises transmitting tubular rotation data on making up the joint.

9. The method of claim 6, wherein the second gripping member includes a counter for collecting tubular rotation data on making up the joint.

10. The method of claim 6, wherein the second gripping member includes a torque sub for collecting data on torque generated in the tubular joint.

11. The method of claim 6, wherein transmitting data comprises transmitting data on torque generated in the tubular joint.

12. The method of claim 6, wherein engaging the second gripping member to the second tubular comprises engaging an inner surface of the second tubular.

13. The method of claim 6, wherein engaging the second gripping member to the second tubular comprises engaging an outer surface of the tubular.

14. The method of claim 6, wherein ensuring the second gripping member is engaged with the tubular string comprises sending a signal to the controller that the second gripping member is engaged to the tubular string.

15. The method of claim 6, wherein the controller is preprogrammed with acceptable values of the joint.

16. The method of claim 15, wherein ensuring the second gripping member is engaged with the tubular string comprises comparing the data with the acceptable values of the joint.

17. The method of claim 16, wherein if the data is within acceptable values then controller sends a signal to the second gripping member to lock in the engaged position, and sends another signal to the first gripping member to unlock.

18. The method of claim 16, wherein if the data is not within acceptable values then the first gripping member remains locked and a signal is sent to an operator to rethread the joint.

19. The method of claim 6, wherein closing the first gripping member around the tubular string includes sending a signal from the first gripping member to the controller.

20. The method of claim 19, wherein if the signal from the first gripping member is received by the controller, the controller then sends the signal to the second gripping member to unlock.

21. The method of claim 6, wherein disengaging the second gripping member from the tubular string includes sending a signal from the controller to the first gripping member to lock.

22. The method of claim 6, wherein the second gripping member further comprises a compensator.

23. The method of claim 22, wherein transmitting data from the second gripping member to the controller includes transmitting data from the compensator to indicate that the second gripping member is engaged to the tubular string.

24. A method of connecting tubulars, comprising:

closing a first member around a first tubular;

engaging a second member to a second tubular;

moving the second tubular to a well center;

threading the second tubular to the first tubular to form a joint and thereby a tubular string;

sending data from the second member to a controller, the second member having a counter that relays data relating to tubular rotations making up the joint;

opening the first member;

lowering the tubular string through the first member;

closing the first member around the tubular string; and disengaging the second member from the tubular string.

25. The method of claim 24, wherein the second member further includes a torque sub adapted to measure torque data on the tubular joint.

26. The method of claim 25, further comprising transmitting the torque data to the controller.

27. A method of connecting tubulars, comprising:

closing a first member around a first tubular;

engaging a second member to a second tubular;

moving the second tubular to a well center;

threading the second tubular to the first tubular to form a joint and thereby a tubular string;

sending data from the second member to a controller, wherein the controller is preprogrammed with acceptable values of the joint;

opening the first member;

lowering the tubular string through the first member;

closing the first member around the tubular string; and disengaging the second member from the tubular string.

28. The method of claim 27, wherein sending data from the second member to the controller comprises comparing the data with the acceptable values of the joint.

29. The method of claim 28, wherein if the data is within acceptable values then controller sends a signal to the second member to lock in the engaged position, and sends another signal to the first member to unlock.

30. The method of claim 28, wherein if the data is not within acceptable parameters then the first member remains locked and a signal is sent to an operator to rethread the joint.

31. A method of connecting tubulars, comprising:

closing a first member around a first tubular;

engaging a second member to a second tubular, wherein second member comprises a compensator;

moving the second tubular to a well center;

threading the second tubular to the first tubular to form a joint and thereby a tubular string;

sending data from the compensator to a controller to indicate that the second member is engaged with the tubular string;

opening the first member;

lowering the tubular string through the first member;

closing the first member around the tubular string; and disengaging the second member from the tubular string.

* * * * *